US006759613B2

(12) United States Patent
Kurihara

(10) Patent No.: US 6,759,613 B2
(45) Date of Patent: Jul. 6, 2004

(54) KEY SWITCH

(75) Inventor: Akio Kurihara, Tokyo (JP)

(73) Assignee: NEC Corporation, Tokyo (JP)

( * ) Notice: Subject to any disclaimer, the term of this patent is extended or adjusted under 35 U.S.C. 154(b) by 13 days.

(21) Appl. No.: 10/105,224

(22) Filed: Mar. 26, 2002

(65) Prior Publication Data

US 2002/0144884 A1 Oct. 10, 2002

(30) Foreign Application Priority Data

Mar. 26, 2001 (JP) ..... 2001-087033

(51) Int. Cl.[7] ..... H01H 9/18
(52) U.S. Cl. ..... 200/314; 200/517; 200/5 A
(58) Field of Search ..... 200/314, 317, 200/517, 513, 5 A

(56) References Cited

U.S. PATENT DOCUMENTS 4,376,879 A * 3/1983 Nagata et al. ..... 200/314
4,403,122 A * 9/1983 Wise, III ..... 200/5 A
4,590,342 A * 5/1986 Schlegel ..... 200/314
4,778,952 A * 10/1988 Watkins et al. ..... 200/314

FOREIGN PATENT DOCUMENTS

| | | |
|---|---|---|
| GB | 2168850 | * 6/1986 |
| JP | 4-127929 | 11/1992 |
| JP | 11-73838 | 3/1999 |

* cited by examiner

*Primary Examiner*—Renee Luebke
(74) *Attorney, Agent, or Firm*—Foley & Lardner LLP

(57) ABSTRACT

A base button 4 wuth a button depressing surface and a shaft portion, and a shaft supporting portion for slidably supporting the shaft portion of the button base 4 are provided. A switch base installable on a print wiring board, a contact rubber providing a conductive portion at a position facing the print wiring board , and a light emitting portion provided on the print wiring board are also included. The shaft portion is lowered by depressing the button depressing surface of the button base 4 and the conductive portion of the contact rubber is lowered until the conductive portion contacts an electrical contact on the print wiring board. Thus, an electrical contact function is exerted and the light emitting portion emits light, when the conducts portion comes into contact with the electrical contact.

33 Claims, 8 Drawing Sheets

(c)

(a)

(b)

KEY SWITCH

BACKGROUND OF THE INVENTION

The present invention relates to a key switch and more particularly to a push-button key switch used in communications units, keyboards for data inputting, operating panels, and the likes Conventionally, a key switch whose light emitting portion of an integrated LED or the like illuminates on pressure of a push button Switch is variously used in communications units, keyboards for data inputting, operating panels, aid the like.

For example, an illuminated push button described in unexamined Japanese Patent Publication No. Hei 11-73838 has an LED and provides a print board on which a wiring pattern is integrated into a base, thus providing for an illuminated push button capable of leading light emitted from a luminous element to a display portion without passing the light through a member manufactured with a sealant Disposed sequentially in a vertical direction on the print board are a silicon cover functioning as a sealant in which a reflect case is integrated and as a movable contact, a reflect case mounted in the silicon cover, a filter fitting with the reflect case and the silicon cover internally, and a lens for covering the above-mentioned elements. The above-mentioned elements are housed in a covering member fixed on the base. Further, the silicon cover has apertures on both upper and lower surfaces, and a conductive portion which contacts the wiring pattern on operation is provided on a lower surface of a corner portion.

On the other hand, in Utility Model Publication No. Hei 4-127929, the construction of a luminous element in a membrane-contact-type keyboard in which a circuit pattern for a luminous element is formed in a spacer of a membrane sheet is disclosed in addition, parts besides an installing portion for the luminous element are subjected to insulation processing, as disclosed, in order to provide for the construction of a luminous element in a membranes contact-type keyboard without requiring a complicated run of a pattern or additional print wiring boards even in the event that the number of luminous elements becomes large.

However, the above-mentioned illuminated push button described in unexamined Japanese Patent Publication No. Hei 11-73838 is composed so as to perform external switch connecting information (an electrical contact) via a connector installed in each button. The connector is required to be installed and soldered on the reverse side of an installed LED, thus causing the problems of cumbersome assembly tasks and lower productivity.

Additionally, for installing the push button, protrusions provided on the base member are composed so as to mate to holes drilled in a board for fixing a plurality of push buttons. In the event of installing a plurality of push buttons, a required number of holes must be drilled in the board for fixing the push buttons. In the event of changing positions of a push button, boards for fixing the push button must be prepared for each disposition of the push button, which causes a problem of having low flexibility in disposing the push button on the print wiring board. Further, a problem also arises in that a high parts count results in high manufacturing costs, because eight parts are required besides the LED to be installed on the print wiring board.

The technology described in Utility Model Publication No. Hei 4-127929 also causes the problems of cumbersome assembly tasks and lower productivity, because the LED must be soldered after installing an LED holder on a substrate disposed on a membrane adjacent surface for each switch unit, and the housing composed to cover the LED is fixed by brackets.

Further, the LED provided in the membrane-contact-type switch is soldered on the substrate and a window for checking whether the light is turned on or off is provided at an upper part of the LED in a key top. While the key top is not depressed, a light emitting surface of the LED is in a state of being buried in the key top, which causes a problem of providing a poor visual recognition for other directions than the upper part of the key top.

Furthermore, a problem arises in that a high parts count results in high manufacturing costs, because six parts are required besides the LED to be installed on the print wiring board.

SUMMARY OF THE INVENTION

In view of the foregoing problems and disadvantages of the conventional technology, it is therefore an object of the present invention to provide a key switch capable of providing outstanding productivity because of easy assembly tasks and a low parts count, high degree of flexibility in disposing the key switch on a print wiring board, and advantages in visual recognition from other directions than an upper part of the key top.

In addition to the above-mentioned advantages, it is another object of the present invention to provide a key switch which can be fixed securely on a print wiring board without misregistration when installed and requires no other part for fixing. It is also an object of the present invention to have adjacent key switches be fixed securely in the event of successive installation of the key switches.

Further, it is still another object of the present invention to provide a key switch for enhancing keying life with high reliability.

To achieve the above-mentioned objects, the invention claimed is a key switch comprising a button base, a switch base, a contact rubber, a light emitting portion, an a light conductive lens:

According to the invention claimed, assembly of the key switch can be performed easily and productivity can be improved because conventional installation, soldering, and the like of a connector is not required for each key switch unit. And, only four parts are required besides an LED to be installed on the print wiring board, which realizes lowered parts count and manufacturing costs.

Further, the above-mentioned switch base may be detachable from the above-mentioned print wiring board. By having the switch base be detachable from the print wiring board, higher flexibility in disposing the key switch on the print wiring board is provided and dispositions can be changed easily. Further, a conventional structure for supporting the key switch is not required and costs for developing an operating panel surface to which the present key switch is applied can be cut down.

The key switch may be mountable on the print wiring board by inserting and locking a lug portion protruding from a lower portion of the switch base to a through hole drilled in the print wiring board. Thus, the key switch can be detachable from the print wiring board with a simple composition The key switch may be registered with respect to the above-mentioned print wiring board by protruding a guide pin at lower portion of the above-mentioned switch base and inserting the guide pin into a fixing hole drilled in the above-mentioned print wiring board.

Registration of the key switch with respect to the print wiring board can be performed by the guide pin of the switch base, which results in avoiding misregistration when installed on the print wiring board.

Switches may be combined firmly to each other even in the event of installing the key switches successively. And, no other part is required for the combination Adjacent key switches may be engagable to each other by fitting a convex portion protruded from the above-mentioned switch base on one side to a concave portion formed in the above-mentioned switch base on the other side of the above-mentioned key switch. Thus, the key switches adjacent to each other can be combined firmly with a simple composition.

A sliding range of the shaft portion of the above-mentioned button base along a shaft supporting portion of the above-mentioned switch base may be set not shorter than a fixed length. For example, by providing that the sliding range is set at not shorter than eight millimeters, slant of the button base and scoring on a sliding surface during sliding can be suppressed and key life of a thousand times can be ensured.

A lens for leading light emitted from a light emitting diode (LED) may be installed in the above-mentioned print wiring board as a light emitting portion for emitting light to outside the key switch through notches formed on a button depressing surface.

According to the invention, for example, an LED illuminated key switch can be disposed successively with 19-millimeter pitch, because the key switch can singly satisfy an emission of light emitting diode (LED) and a function of electrical contact A label may be provided removably on a button depressing surface of the above-mentioned button base.

A key cap way also be provided for surrounding the button depressing surface of the button base mountably on the above-mentioned button base.

DETAILED DESCRIPTION OF THE PREFERRED EMBODIMENTS

Figure 1:
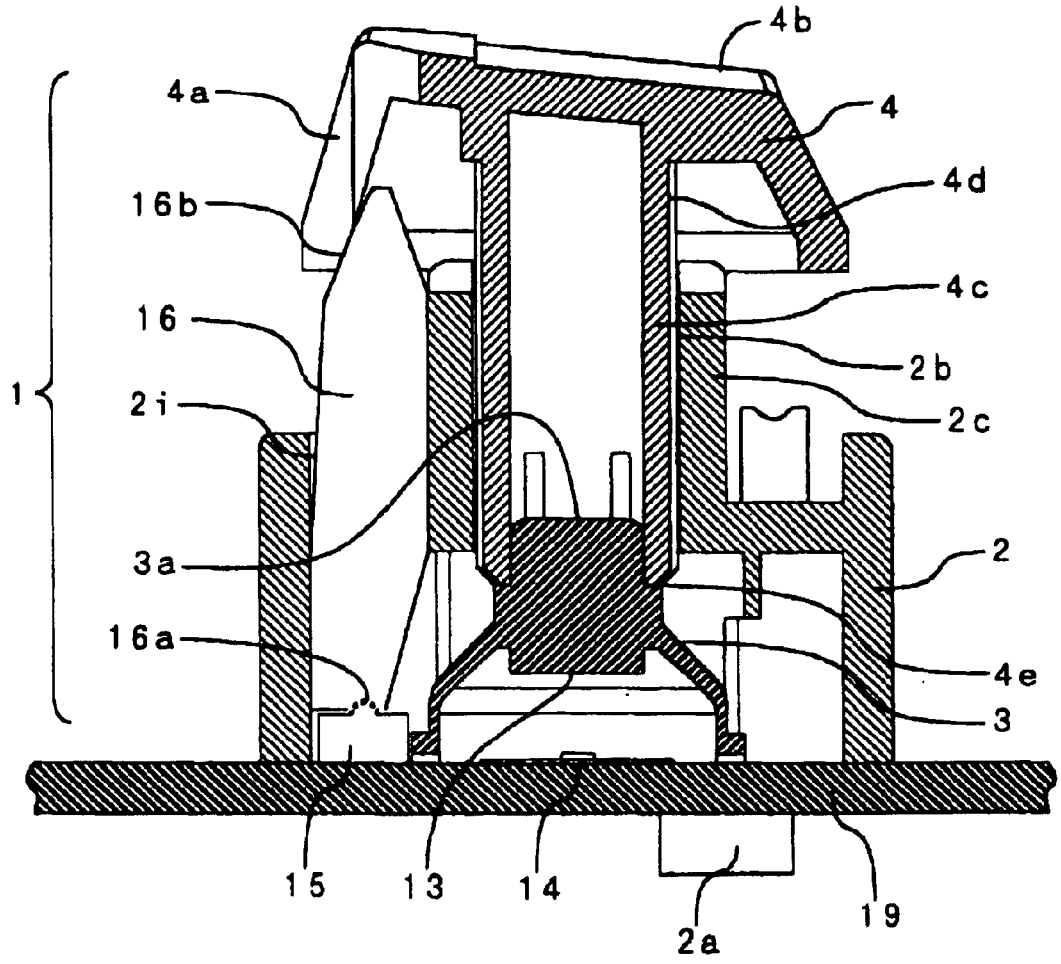
FIG. 1 is a sectional view for illustrating a first embodiment of a key switch relating to the present invention.
Figure 2:
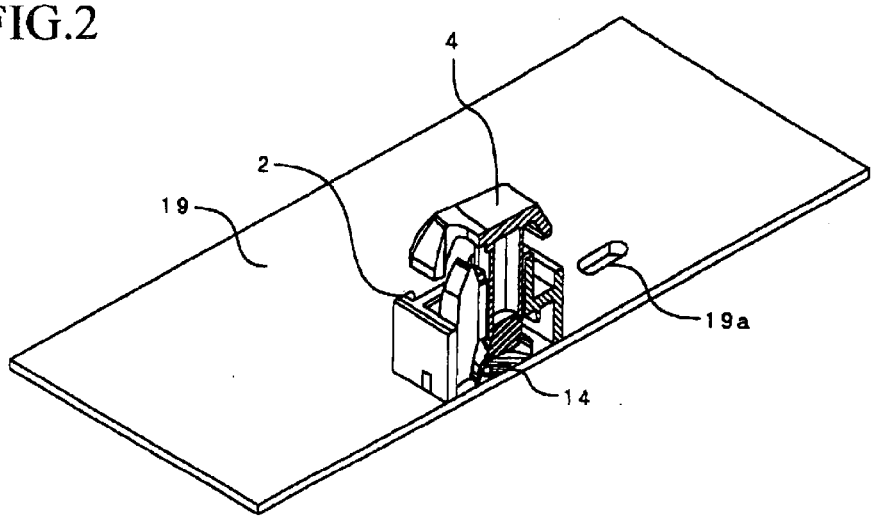
FIG. 2 is a partially interrupted perspective view for showing the key switch of FIG. 1.

Referring now to the drawings, concrete examples of preferred embodiments of a key switch relating to the present invention are described as follows.

FIGS. 1 through 7 illustrate the key switch relating to the present invention, which broadly comprises a switch base 2, a button base 4, a contact rubber 3, a light conducive lens 16, a key cap 29 (FIG. 5) and a label 31.

Figure 3:
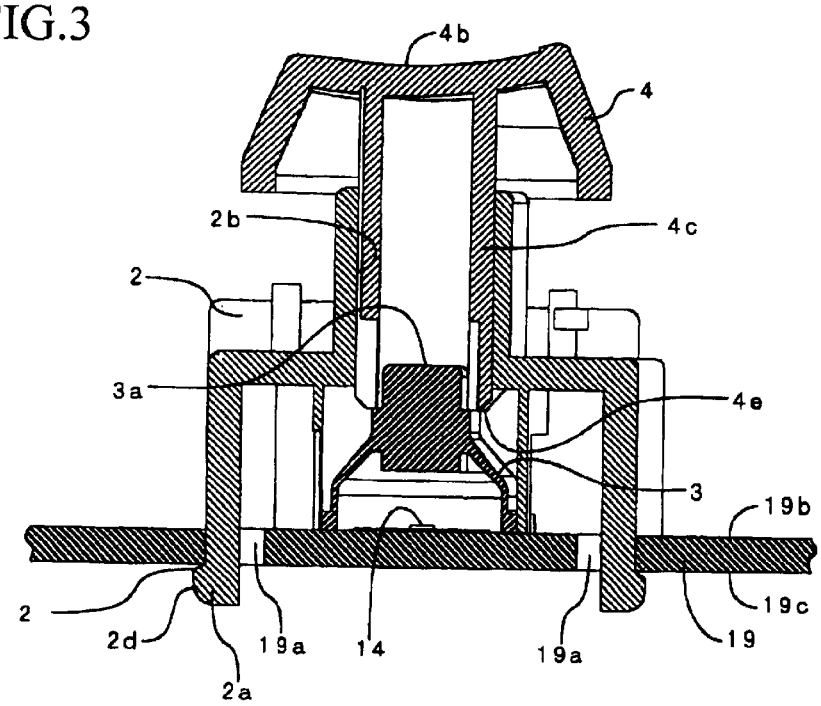
FIG. 3 is a sectional view for showing the key switch of FIG. 1 illustrating a state in which a lug of the key switch is inserted into a print wiring board.
Figure 4:
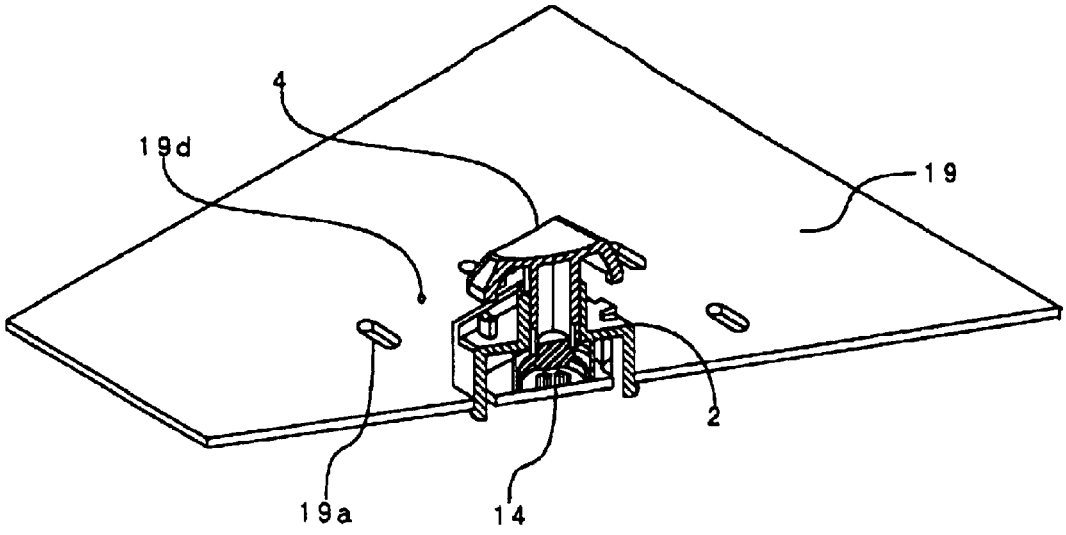
FIG. 4 is a partially interrupted perspective view for showing the key switch of FIG. 3.
Figure 7:
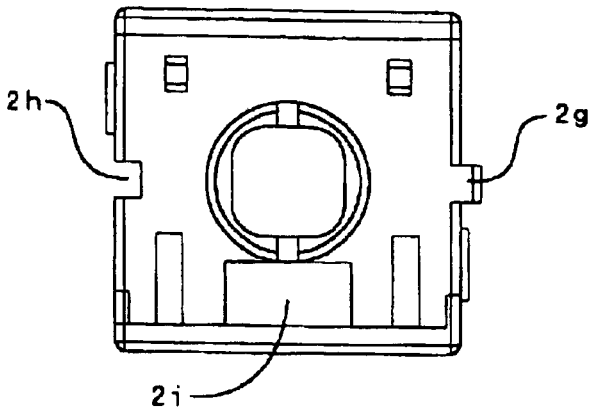
FIG. 7 is a three-view diagram for showing the switch base of the key switch of FIG. 1 and (a), (b) and (c) are a front view, a side view and a top view thereof respectively.
Figure 7:
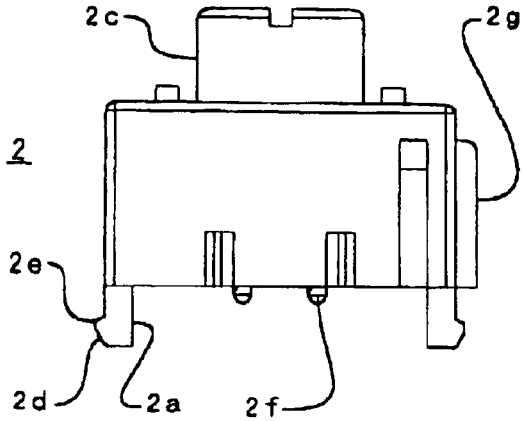
Figure 7:
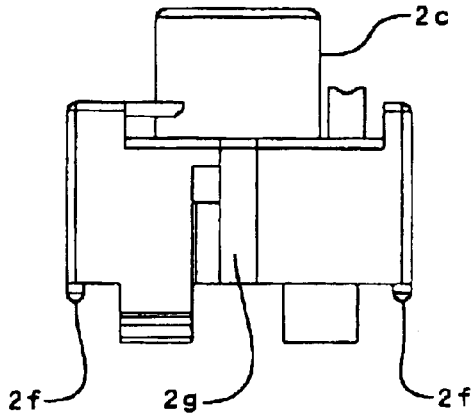

As shown in FIGS. 1, 3 and 7 the switch base 2 comprises a shaft supporting portion 2*c* with a sliding surface 2*b*, a lug 2*a* with a lug taper portion 2*d* and a protruding surface 2*e*, a guide pin 2*f*, a switch base convex portion 2*g*, a switch base concave portion 2*h* and a light conductive lens supporting portion 2*i*.

As shown in FIG. 3, the lug 2*a* is inserted into an through hole 19*a* processed in a print wiring board 19 and provided for fixing the key switch 1 securely to the print wiring board 19.

As shown in FIGS. 1 and 3, the shaft supporting portion 2*c* provides the sliding surface 2*b* for supporting a shaft portion 4*c* of the button base 4, in which the sliding surface 2*b* is formed of a slidable ABS or a nylon resin and extended, for example, not shorter than 8 millimeters in a sliding direction of the button base 4 in order to reserve stable slide along the shaft portion sliding surface 4*d*.

Figure 5:
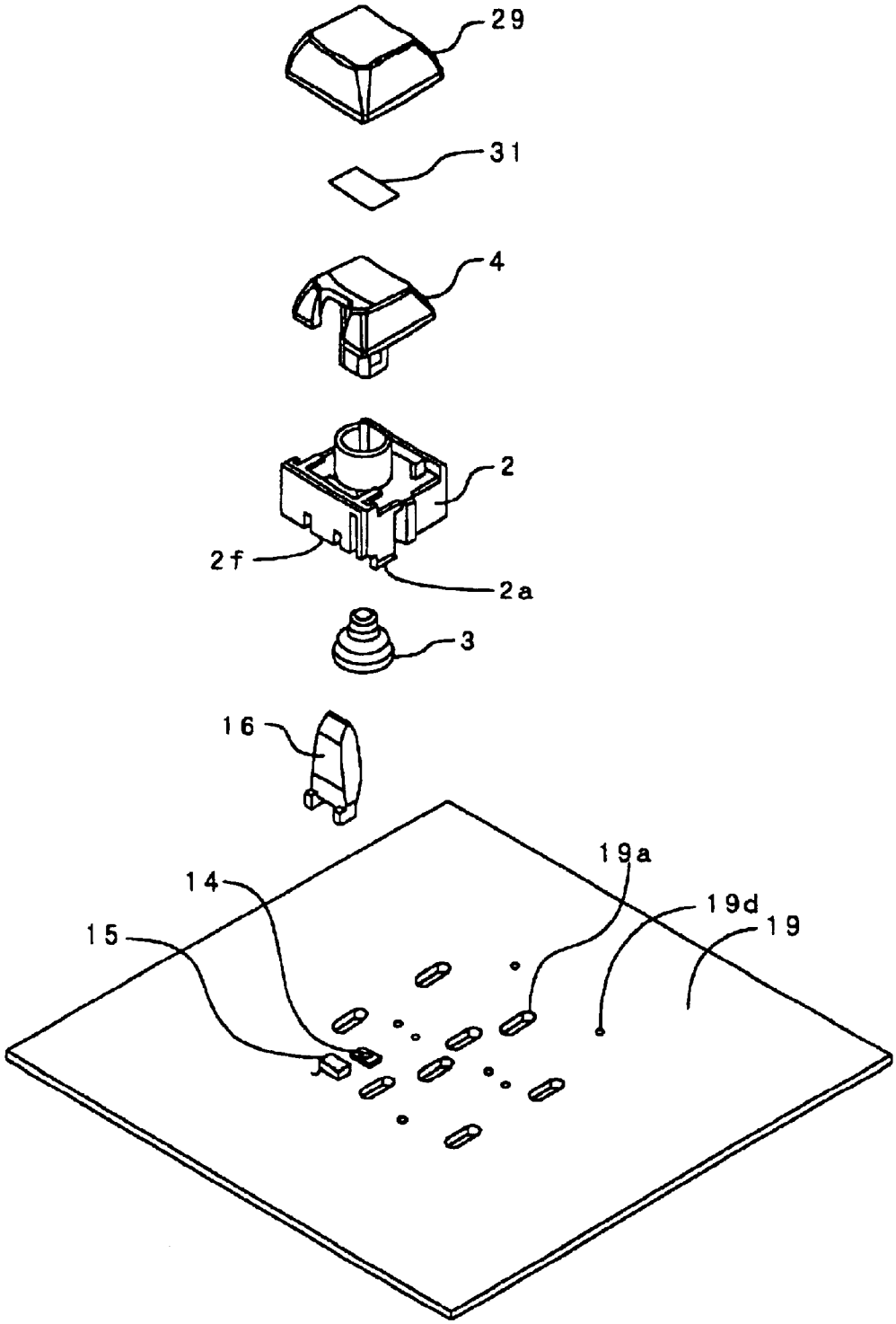
FIG. 5 is an exploded perspective view for showing the key switch of FIG. 1.
Figure 6:
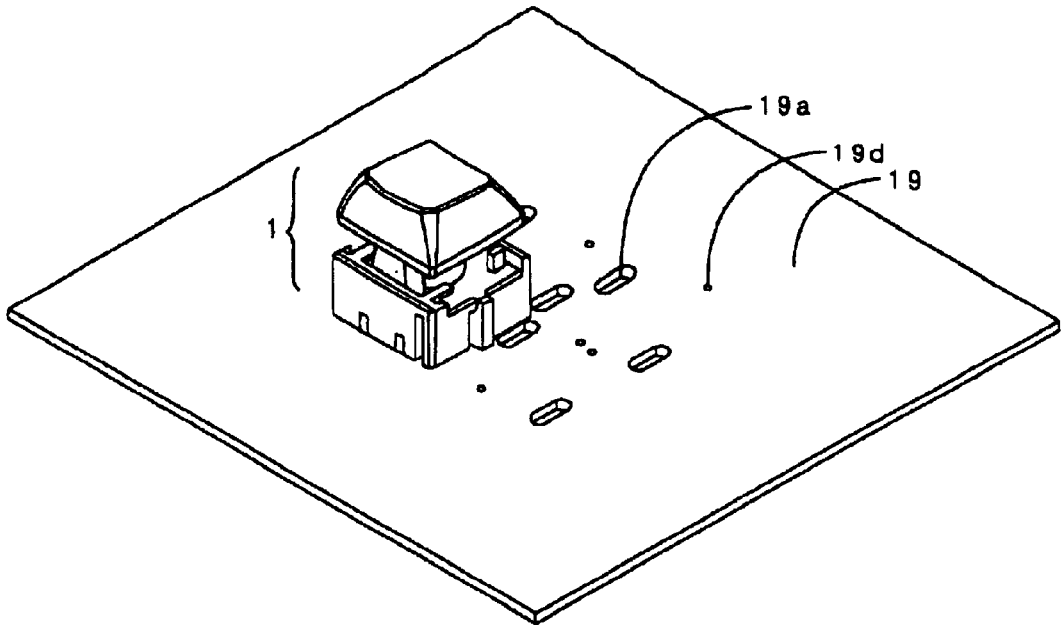
FIG. 6 is an assembling perspective view for showing the key switch of FIG. 5.

As shown in FIG. 3, the lug taper 2*d* is provided for serving an insertion of the lug 2 into the through hole 19*a* when the switch base 2 is fixed on a part installing surface 19*b* of the print wiring board 19. And the protruding surface 2*e* is locked to a reverse side 19*c* of the print wiring board 19 after the switch base 2 is mounted on the print wiring board 19 and prevents the switch base 2 from removing from the print wiring board 19. Further, the guide pin 2*f* is provided for guiding the switch base 2 to the print wiring board 19 when the switch base 2 is fixed and inserted into the through hole 19*a* of the print wiring board 19, as shown in FIG. 5.

Figure 8:
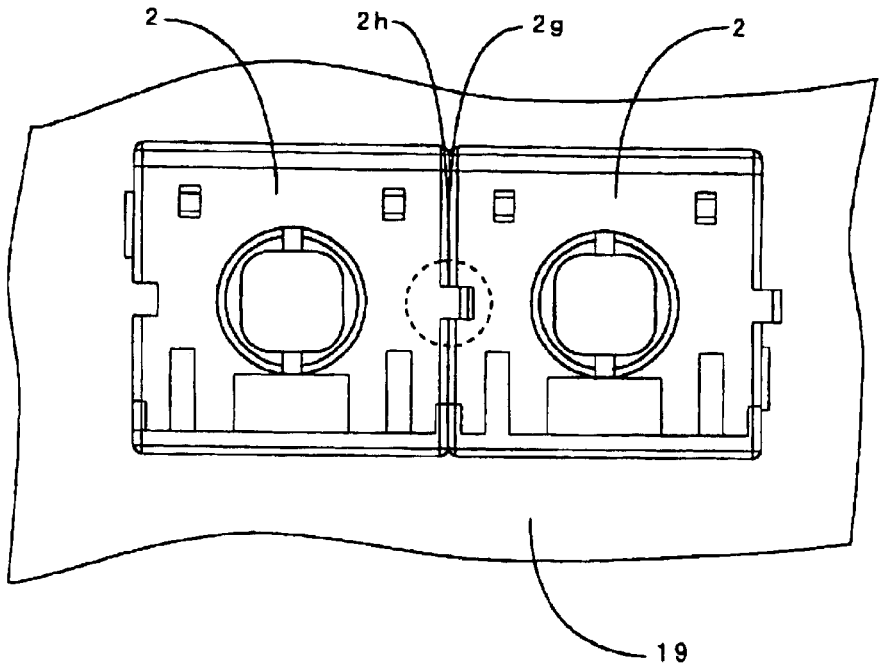
FIG. 8 is a top view for illustrating the key switches of FIG. 1 in the state of being installed successively.

As shown in FIG. 8, the switch base convex portion 2*g* and switch base concave portion 2*h* provided on a side surface of the switch base 2 are provided for fitting and fixing the switch base convex portion 2*g* and switch base concave portion 2*h* adjacent to each other, in the event of a successive installation of the switch base 2.

As shown in FIG. 1, the light conductive lens supporting portion 2*i* provided On an upper surface of the switch base 2 fixes and supports the light conductive lens 16.

As shown in FIGS. 1 and 3, the button base 4 provides the shaft portion 4*c* supported by the shaft supporting portion 2*c* of the switch base 2, in which the slidable ABS or the nylon resin for enhancing slideably are used in the shaft portion sliding surface 4*d* slideably connected to the sliding surface 2*b*. The shaft portion depressing surface 4*a* of the shaft portion 4*c* is accessible to the contact rubber 3 and depressed the contact rubber 3 down via the shaft portion depressing surface 4*e* when the button base 4 is depressed. Then, the conductive portion 13 contacts the electrical contact copper foil portion 14 and satisfies the electrical contact function as a key switch. Further, a notch 4*a* of the button base 4 is formed to lead the light emitted from a chip LED 15 to outside via the light conductive lens 16.

As shown in FIG. 5, the button base 4 is composed to have the label 31 affixed thereon and to be covered by the key cap 29.

As shown in FIGS. 1 and 3, the contact rubber 3 is located at lower part of the button base 4 in the switch base 2 and provides the contact rubber depressing surface 3*a* accessible to the shaft portion depressing surface 4*e*. The conductive portion 13 is welded at a lower portion of a main body of the contact rubber 3.

As shown in FIG. 1, the light conductive lens 16 is installed in the switch base 2 and supported by the light conductive lens supporting portion 2*i*. The light conductive lens 16 comprises a light receiving surface 16*a* and light emitting surface 16*b* and leads the light emitted from the chip LED 15 to the notch 4*a* of the button base 4.

As shown in FIGS. 1 and 3, the chip LED 15 is installed on the print wiring board 19 and the electrical contact copper foil portion 14 is formed on a surface opposing to the conductive portion 13 of the contact robber 3. And as shown in FIG. 5, the through hole 19*a*and the fixing hole 19*b* to which the lug 2*a* of the switch base 2 and the guide pin 2*f* are inserted respectively are drilled.

Incidentally, it is preferable to use UL-recognized material with high flame resistance for the above-mentioned components.

Referring now to FIG. 5, a sequence of assembling the key switch having the above-mentioned composition will be discussed.

At first, the electrical contact copper foil portion 14 is formed on the print wiring board 19 on which the chip LED 15 is installed. Then, the contact rubber 3 is placed at a lower portion of the button base 4, after the light conductive lens 16 is installed in the switch base 2 and the shaft portion 4*c* is inserted into the shaft supporting portion 2*c*. The key cap 29 is placed over the button base 4 with the label 31 affixed thereon.

Thereafter, the lug 2*a* is inserted into the through hole 19*a* while the guide pin 2*f* of the switch base 2 is inserted into the fixing bole 19*d* of the print wiring board 19. Then, the lug taper portion 2*d* of the lug 2*a* descends sliding along the inner periphery of the through hole 19*a*. When the lug 2*a* is completely inserted, the protruding surface 2*e* is locked to the reverse surface 19*c* of the print wiring board 19 and installation of the key switch 1 on the print wiring board 19 is completed.

Next, an operation of the key switch having the above-mentioned composition is described.

In FIGS. 1 and 3, when an operator depresses the button depressing surface 4*b* of the button base 4, the contact rubber depressing surface 3*a* of the contact rubber 3 is depressed by the shaft portion depressing surface 4*e*.

Further the conductive portion 13 welded to the contact rubber 3 is depressed and contacts the electrical contact copper foil portion 14 formed in the print wiring board 19, thereby establishing the electrical contact function.

Thereafter, when the chip LED 15 illuminates after the conductive portion 13 contacts the electrical contact copper foil portion 14, the light emitted from the chip LED 15 is led from the light receiving surface 16*a* to the light emitting surface 16*b* of the light conductive lens 16 and further to outside via the notch 4*a* of the button base 4, which enables the operator and third parties to recognize the illumination.

Incidentally, as shown in FIG. 8, in the event that the switch bases 2 are installed successively on the print wiring board 19, the switch base convex portion 2*g* and the base concave portion 2*h* adjacent thereto can be fitted and fixed to each other.

Figure 9:
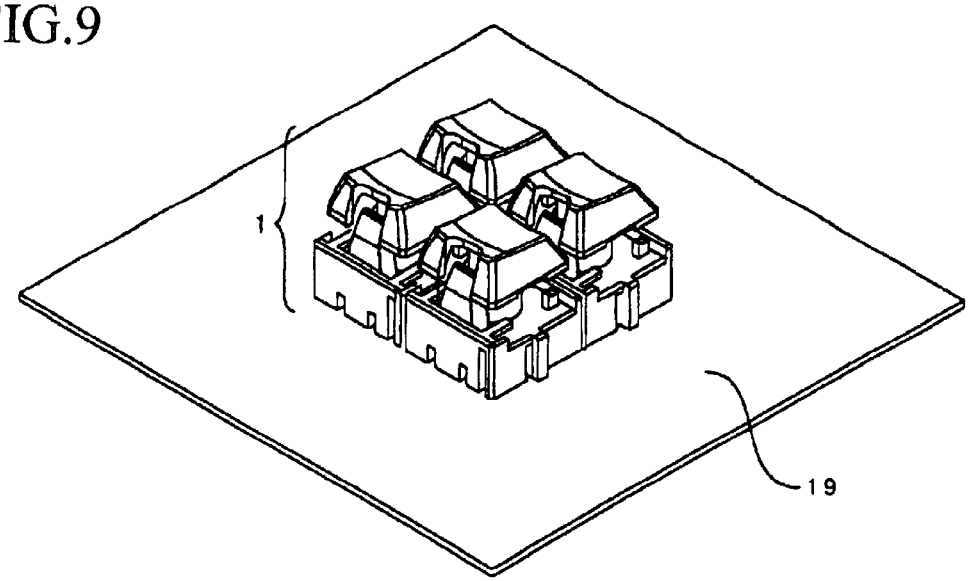
FIG. 9 is a perspective view for illustrating four of the key switches of FIG. 1 in the state of being installed successively on print wiring boards.

FIG. 9 illustrates the key switches 1 in the state of being installed successively on the print wiring portion 19. The LED illuminated key switch can be installed systematically, or example, with 19-millimeter pitch on the print wiring board 19.

Figure 10:
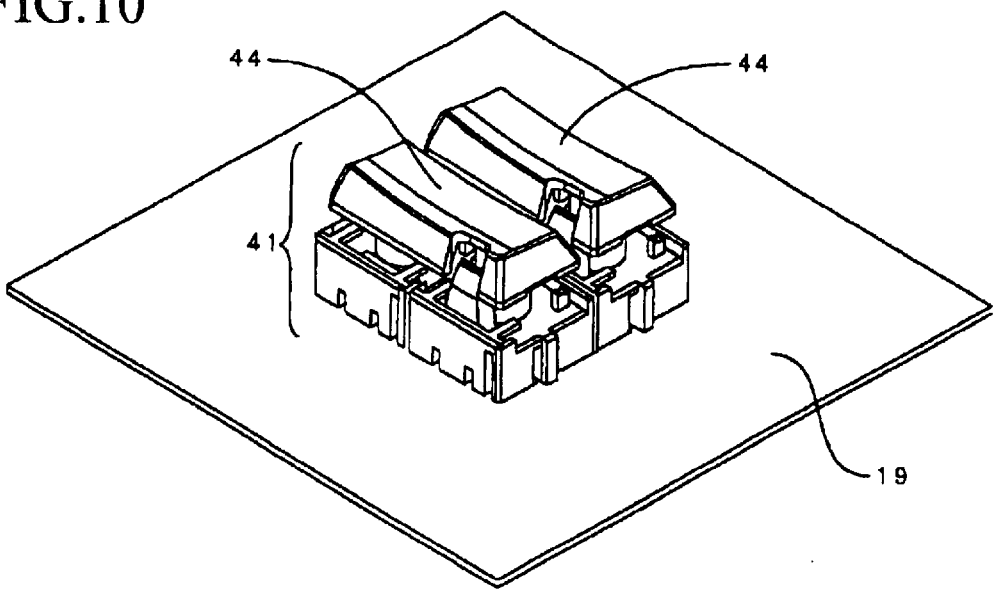
FIG. 10 is a perspective view for illustrating a second embodiment of the key switch relating to the present invention.

Referring now to FIG. 10, a second embodiment of the key switch relating to the present invention is described.

The key switch 41 relating to the present embodiment is indicated in the event of extending a side in the shape of the button base 4 to be twice in length and can be corresponded only by changing the button base 4 of the key switch 1 in the first embodiment to a button base 44. Thus, key switches having button bases in various shapes can be disposed functionally on an operation panel, which can achieve enhancement of operability and development to designing of operation panel surfaces effectively.

Figure 11:
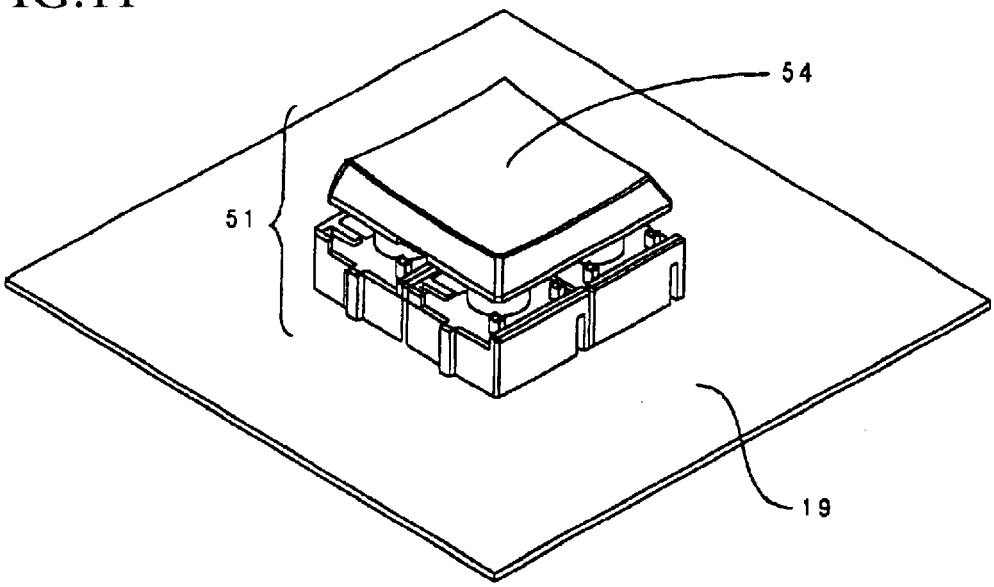
FIG. 11 is a perspective view for illustrating a third embodiment of the key switch relating to the present invention.

Referring now to FIG. 11, a third embodiment of the key switch relating to the present invention is described.

The key switch 51 relating to the present embodiment is indicated in the event of expanding the shape of the button base 4 to be four times in size and can be corresponded only by changing the button base 4 of the key switch 1 in the first embodiment to a button base 54. Thus, similar effects as the second embodiment can be obtained.

As clear from the description above, according to the present invention, a key switch with high productivity, high degree of flexibility in disposing on a print wiring board and excellent visual recognition from other directions than an upper part of the key top can be provided.

What is claimed is:

1. A key switch comprising:

a button base having a button depressing surface and a peripheral surface positioned at an angle with respect to said button depressing surface and a shaft portion, a switch base mountable on a print wiring board having a shaft supporting portion for slidably supporting the shaft portion of said button base, a contact rubber mountable on said print wiring board and in contact with an end portion of said shaft portion, and having a conductive portion facing said print wiring board, said contact rubber movable between a first and second position, said first position in which said conductive portion makes contact with an electrical contact mountable on said print wiring board, said second position in which said conductive portion does not make contact with said electrical contact, depression of said button depressing surface causing said shaft portion to move said contact rubber to said first position, a light emitting portion mountable on said print wiring board, said light emitting portion emitting light when said contact rubber is moved to said first position, and a light conductive lens having a light emitting surface, said light conductive lens transmitting light emitted from said light emitting portion to said light emitting surface, said light emitting surface visible through a notch formed in said peripheral surface.

2. A key switch as claimed in claim 1, wherein a label is removably affixed on the button depressing surface of said button base.

3. A key switch as claimed in claim 1, further comprising a key cap for insertably surrounding the button depressing surface of the button base.

4. A key switch as claimed in claim 1, wherein said switch base is detachable from said print wiring board.

5. A key switch as claimed in claim 4, wherein a guide pin is protruded from a lower portion of said switch base and registration of said key switch with respect to said print wiring board is performed by inserting said guide pin into a fixing hole drilled in said print wiring board.

6. A key switch as claimed in claim 4, wherein said switch base of said key switch is engagable with a switch base of an adjacent key switch.

7. A key switch as claimed in claim 4, wherein a sliding range of the shaft portion of said button base along the shaft supporting portion of said switch base is set not shorter than a fixed length.

8. A key switch as claimed in claim 4, wherein a label is removably affixed on the button depressing surface of said button base.

9. A key switch as claimed in claim 4, further comprising a key cap for insertably surrounding the button depressing surface of the button base.

10. A key switch as claimed in claim 4, wherein a lug portion is protruded from a lower portion of said switch base and said key switch is installable on said print wiring board by inserting and locking the lug portion in a through hole drilled in said print wiring board.

11. A key switch as claimed in claim 10, wherein a guide pin is protruded from a lower portion of said switch base and registration of said key switch with respect to said print wiring board is performed by inserting said guide pin into a fixing hole drilled in said print wiring board.

12. A key switch as claimed in claim 10, wherein said switch base of said key switch is engagable with a switch base of an adjacent key switch.

13. A key switch as claimed in claim 10, wherein a sliding range of the shaft portion of said button base along the shaft supporting portion of said switch base is set not shorter than a fixed length.

14. A key switch as claimed in claim 10, wherein a label is removably affixed on the button depressing surface of said button base.

15. A key switch as claimed in claim 10, further comprising a key cap for insertably surrounding the button depressing surface of the button base.

16. A key switch as claimed in claim 1, wherein a guide pin is protruded from a lower portion of said switch base and registration of said key switch with respect to said print wiring board is performed by inserting said guide pin into a fixing hole drilled in said print wiring board.

17. A key switch as claimed in claim 16, wherein said switch base of said key switch is engagable with a switch base of an adjacent key switch.

18. A key switch as claimed in claim 16, wherein a sliding range of the shaft portion of said button base along the shaft supporting portion of said switch base is set not shorter than a fixed length.

19. A key switch as claimed in claim 16, wherein a label is removably affixed on the button depressing surface of said button base.

20. A key switch as claimed in claim 16, further comprising a key cap for insertably surrounding the button depressing surface of the button base.

21. A key switch as claimed in claim 1, wherein said switch base of said key switch is engagable with a switch base of an adjacent key switch.

22. A key switch as claimed in claim 21, wherein a sliding range of the shaft portion of said button base along the shaft supporting portion of said switch base is set not shorter than a fixed length.

23. A key switch as claimed in claim 21, wherein a label is removably affixed on the button depressing surface of said button base.

24. A key switch as claimed in claim 21, further comprising a key cap for insertably surrounding the button depressing surface of the button base.

25. A key switch as claimed in claim 21, wherein said key switch has a convex portion protruded from one side of said switch base and a concave portion formed in another side of said switch base, said key switch being engagable to said adjacent key switch by fitting a said convex portion protruded from said switch base of said key switch into a concave portion formed in said switch base of said adjacent key switch.

26. A key switch as claimed in claim 25, wherein a sliding range of the shaft portion of said button base along the shaft supporting portion of said switch base is set not shorter than a fixed length.

27. A key switch as claimed in claim 25, wherein a label is removably affixed on the button depressing surface of said button base.

28. A key switch as claimed in claim 25, further comprising a key cap for insertably surrounding the button depressing surface of the button base on said button.

29. A key switch as claimed in claim 1, wherein a sliding range of the shaft portion of said button base along the shaft supporting portion of said switch base is set not shorter than a fixed length.

30. A key switch as claimed in claim 29, wherein a label is removably affixed on the button depressing surface of said button base.

31. A key switch as claimed in claim 29, further comprising a key cap for insertably surrounding the button depressing surface of the button base.

32. A key switch comprising:

a button base having a button depressing surface, and a peripheral surface positioned at an angle with respect to said button depressing surface, and a shaft portion;

a switch base mountable on a print wiring board having a shaft supporting portion for slidably supporting the shaft portion of said button base;

a light emitting portion mountable on said print wiring board, said light emitting portion emitting light when said button base is depressed; and a light conductive lens having a light emitting surface, said light conductive lens transmitting light emitted from said light emitting portion to said light emitting surface, said light emitting surface visible through a notch formed in said peripheral surface;

whereby light emitted from said light emitting surface passes through said notch in said peripheral surface.

33. A key switch as claimed in claim 32, wherein said light conductive lens is connected to said switch base.

* * * * *